US010300311B2

(12) United States Patent
Rose

(10) Patent No.: US 10,300,311 B2
(45) Date of Patent: May 28, 2019

(54) ROSES IRON CURTAIN ENTRY TOOL

(71) Applicant: Eric Ramone Rose, Highland, CA (US)

(72) Inventor: Eric Ramone Rose, Highland, CA (US)

( * ) Notice: Subject to any disclaimer, the term of this patent is extended or adjusted under 35 U.S.C. 154(b) by 0 days.

(21) Appl. No.: 16/148,916

(22) Filed: Oct. 1, 2018

(65) Prior Publication Data

US 2019/0099627 A1 Apr. 4, 2019

Related U.S. Application Data

(60) Provisional application No. 62/566,003, filed on Sep. 29, 2017.

(51) Int. Cl.

| | |
|---|---|
| ***A62B 3/00*** | (2006.01) |
| ***A61G 1/048*** | (2006.01) |
| ***A61G 1/01*** | (2006.01) |
| ***B25F 1/00*** | (2006.01) |

(52) U.S. Cl.

CPC ..... *A62B 3/005* (2013.01); *A61G 1/01* (2013.01); *A61G 1/048* (2013.01); *B25F 1/00* (2013.01)

(58) Field of Classification Search

CPC .... B66F 3/00; B66F 3/247; B66F 9/00; B66F 9/04; A62B 3/00; A62B 3/005

See application file for complete search history.

(56) References Cited

U.S. PATENT DOCUMENTS

| | | | | | |
|---|---|---|---|---|---|
| 3,762,688 | A * | 10/1973 | Leonhardt | A62B 3/005 | 254/133 R |
| 4,973,028 | A * | 11/1990 | Linster | A62B 3/005 | 254/93 R |
| 5,297,780 | A * | 3/1994 | Hickerson | A62B 3/005 | 254/124 |
| 5,544,862 | A * | 8/1996 | Hickerson | A62B 3/005 | 254/124 |
| 5,622,353 | A * | 4/1997 | Painter | A62B 3/005 | 254/93 R |
| 5,810,333 | A * | 9/1998 | Hickerson | A62B 3/005 | 254/133 R |
| 6,244,568 | B1 * | 6/2001 | Patton | A62B 3/005 | 254/93 H |
| 9,517,363 | B1 * | 12/2016 | Thaw | A62B 3/005 | |
| 2005/0109995 | A1 * | 5/2005 | Kirchner | A62B 3/005 | 254/1 |
| 2010/0025647 | A1 * | 2/2010 | Strohmeier | A62B 3/005 | 254/93 R |

* cited by examiner

*Primary Examiner* — Lee D Wilson

(57) ABSTRACT

The iron entry tool is a multifunctional device for building and vehicle forced entry, flow path blocking, rescue tarp, patient carrier. The entry tool comprises a modular structure that can fit into a wide variety of building openings and vehicle doors that are cut out under traffic collision incidents. The power alarm system of the tool provides critical safety features for rapid egress of firefighters. The canvas of the entry tool can be conveniently rewound to provide an user an efficient way to store and carry the Roses iron entry toll.

19 Claims, 7 Drawing Sheets

ROSES IRON CURTAIN ENTRY TOOL

The current application claims a priority to the U.S. Provisional Patent application Ser. No. 62/566,003 filed on Sep. 29, 2017. The current application is filed on Oct. 1, 2018 while Sep. 29, 2018 was on a weekend.

FIELD OF THE INVENTION

The present invention relates generally to an entry tool. More specifically, the present invention relates to a multi-functional iron entry tool with a modular end and a power alarm system that particularly exemplifies a forced entry tool, a flow path blocking device, a rescue tarp, a patient carrier, and a vehicle door prying tool for rescuing injured people in a traffic collision.

BACKGROUND OF THE INVENTION

Firefighters normally need to carry heavy tools and equipment going into a hazardous environment in a building fire, for instance. Usually the load of the tools and equipment is so heavy that it must be notably split and divided up, resulting in cumbersome practices and substantially large teams to carry the requisite tools. Specifically, these tools are related to forced entry tools, entryway retention tools such as door wedges, flow path blocking devices such as canvases with fire mitigation properties and alarm systems that are separate and disparate conventionally. Presently, most smoke blocking devices are designed to fit a door or window of a building using support frames. More specifically this type of device does not include a door jam to keep the door open while providing the smoke blocking function. Thus, this design requires the door to be removed before installing the support frame and the smoke blocking device. Additionally, a horizontal bar is often required to be installed on the upper portion of the opening for hanging the canvas, which presents a hazard to the firefighters going through the blockage canvas. Another problem with this type of smoke blocking device is that there is no lighting providing for either the interior or emergency egress. Furthermore, most smoke blocking devices are bulky and large presenting additional challenge for firefighters to carry and store on their engines.

One objective of the present invention is to provide a solution to the aforementioned problems. The present invention is an apparatus that produces a combination of a forced entry tool, a flow path blocking device, a tarp covering a patient's fluids, and a carrier for the rescuers to efficiently transport the injured during a traffic collision. The present invention includes a canvas that may be wrapped and secured around a plurality of telescoping rods that constitute a bar jam. Additionally, the present invention comprises a bar jam that is conveniently installed at the very top of an opening, which eliminates the hazard that firefighters and/or rescuers may hit their heads going through the blocked opening. Another objective of the present invention is to provide a door wedge attached to the bar jam, when affixed, operates as a forced entry and when removed, operates as an entryway retention tool or door jam. Furthermore, the apparatus may operate as an indicator/alarm system through a plurality of lights and audio system secured to the bottom edge of the canvas that are both activated by a plurality of buttons that may aid in navigating an area with obscuring conditions such as smoke and the like. By centralizing the aforementioned system to the bar jam and subsequently the canvas, the present invention provides an apparatus that conglomerates the requisite tools of a firefighter or emergency responder in a hazardous environment including a forced entry tool, an entryway retention tool, a flow path alteration tool, and an indication and/or alert system to aid in navigation and response of rapid intervention crews. The present invention can be used as a tarp and a patient carrier. More specifically, a rescuer and/or emergency responder can use the present invention as a tarp to cover a patient or an injured person to provide protections for themselves from infection from the patient's body fluids such as blood, vomit, etc. Subsequently, the rescuer and/or emergency responder can use the present invention to carry the patient as a safe transportation tool. In a traffic collision, for instance, rescuer and/or emergency responder can use the present invention as a door prying tool, and then as a tarp to cover the injured person for protection. Further, the present invention provides lighting for the rescuer to see by the feet when the patient is trapped in their vehicle.

DETAIL DESCRIPTIONS OF THE INVENTION

All illustrations of the drawings are for the purpose of describing selected versions of the present invention and are not intended to limit the scope of the present invention.

Figure 1:
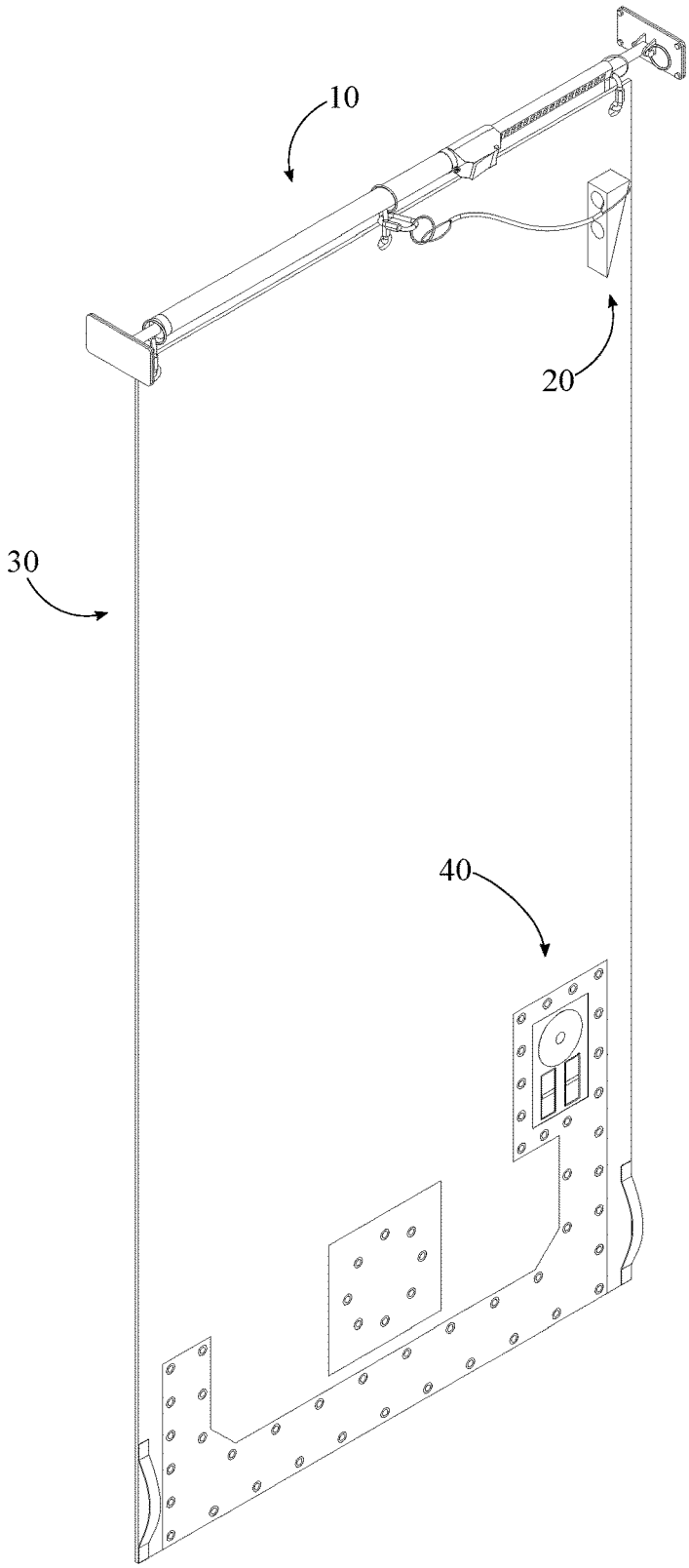
FIG. 1 is an isometric perspective front view of the present invention.
Figure 2:
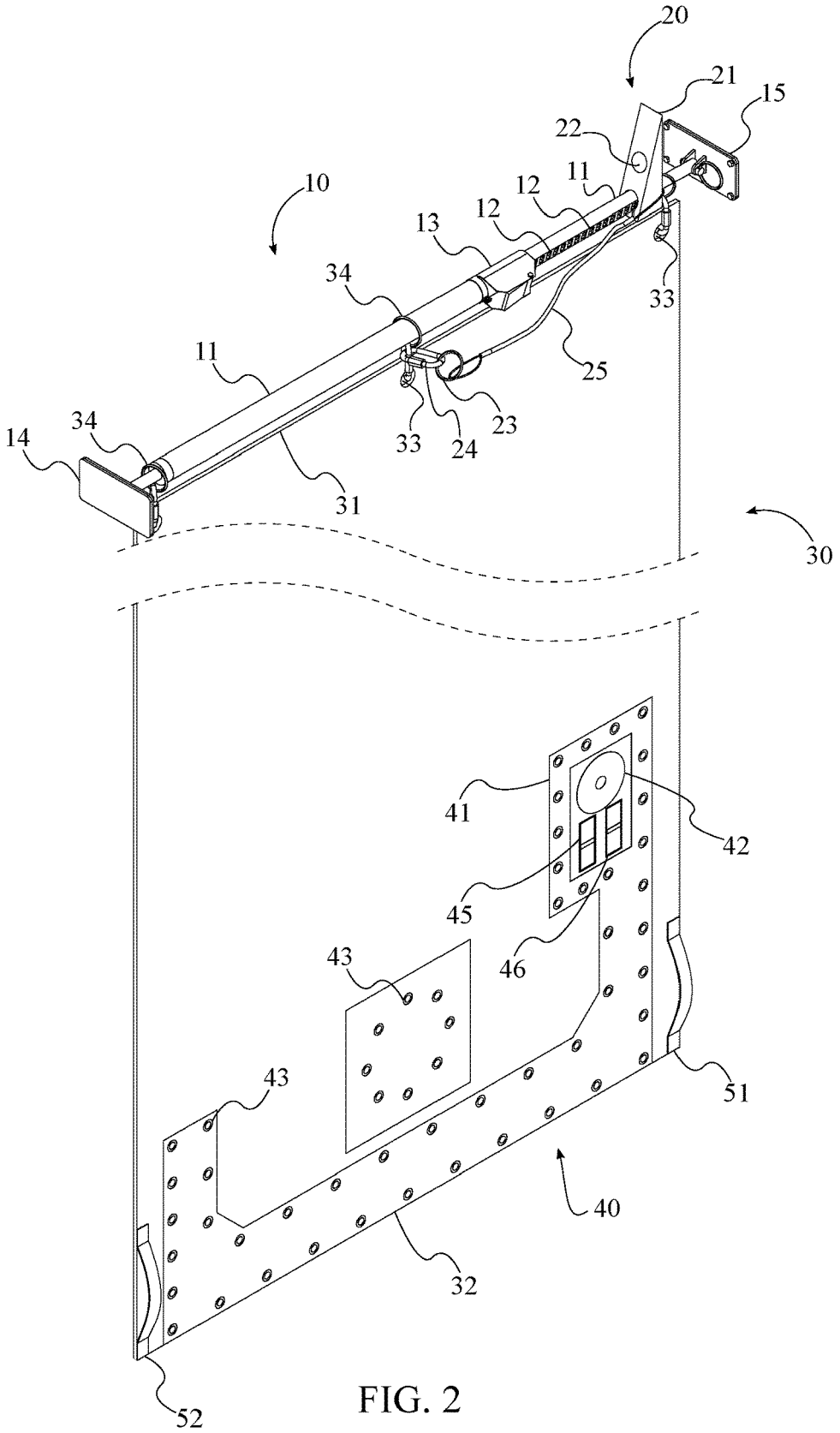
FIG. 2 is an isometric perspective front view of the present invention showing the door wedge mounted on the bar jam.

In reference to FIGS. 1-2, the present invention, named Roses Iron Curtain Entry Tool, is generally a combination tool that would be particularly used for emergency responders and the like through a plurality of subsystems, conducive to hazardous environments. The present invention comprises a bar jam 10, a door wedge 20, a canvas 30, a power alarm system 40, a first handle 51, and a second handle 52. The bar jam 10 provides structure support for the canvas 30 when installed in an opening. The canvas 30 functions as a flow blocking tool, a tarp to cover a patient for protection, and a patient carrier. Additionally, the canvas 30 can be conveniently rolled up and affixed to the bar jam 10, when not in use, for convenient transportation and storage. The door wedge 20 is attached to the bar jam 10 and can be used to keep a door open. Additionally, the door wedge 20 can be used as a door prying tool in a traffic collision, for instance, to assist in rescuing injured persons in a vehicle. The power alarm system 40, the first handle 51, and the second handle 52 are positioned on the canvas 30. The power alarm system 40 provides lighting and audio alarm to the emergency responders and like, while the first handle 51 and the second handle 52 allow the rescuers to efficiently use the present invention to carry a patient and/or an injure person.

Figure 6:
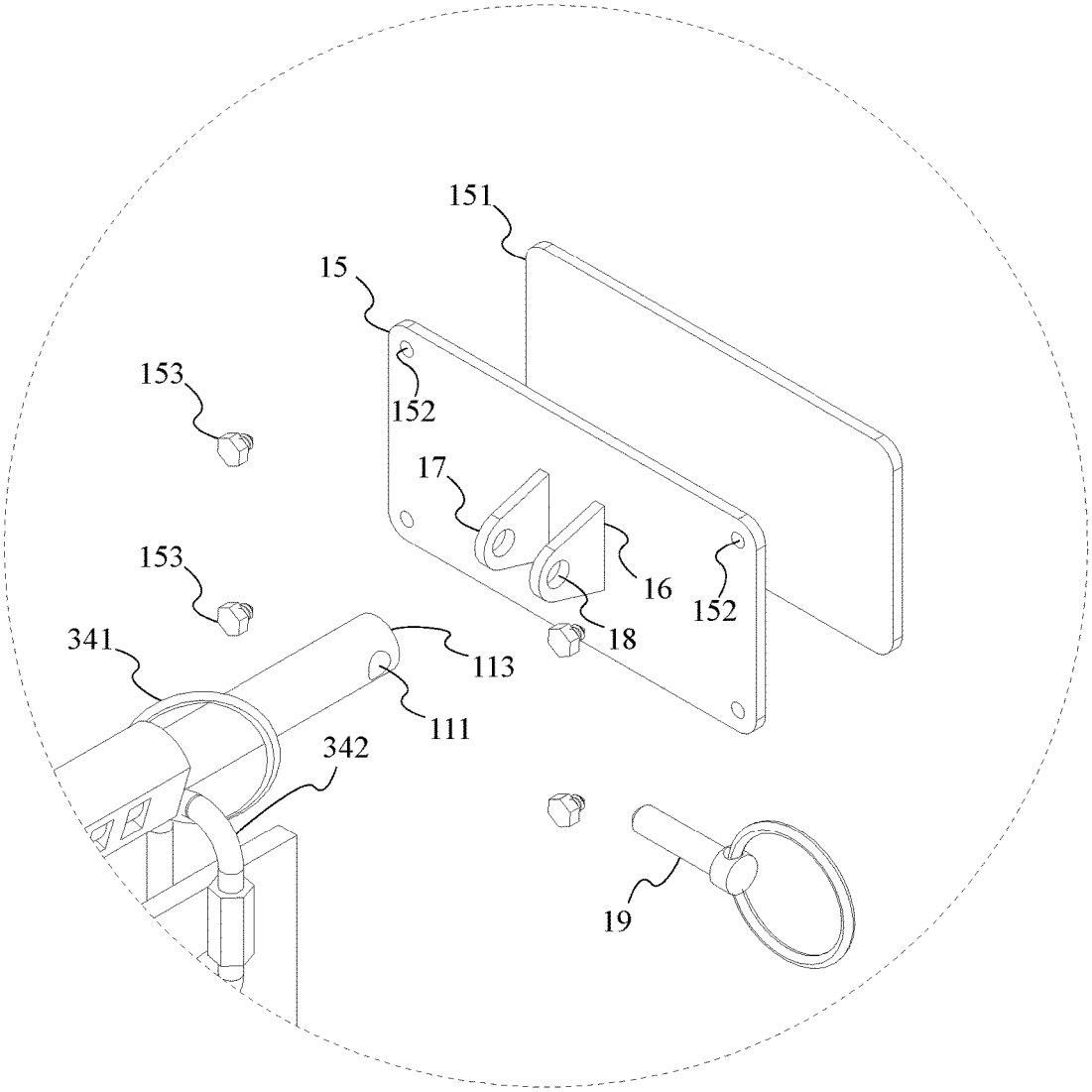
FIG. 6 is an exploded detail view of section A of the present invention.

In reference to FIGS. 2 and 6, the bar jam 10 comprises a plurality of telescoping rods 11, a plurality of apertures 12, a locking mechanism 13, a first end bracket 14, a second end bracket 15, and a ring head pin 19. The plurality of telescoping rods 11 is a preferably rigid and extending body which all subsystems and structures are preceded by. The plurality of telescoping rods 11 is capable of resisting torsional forces therein when the present invention is actively in use as a forced entry tool for a purchase point on vehicle doors and structure doors. Each of the plurality of telescoping rods 11 is positioned concentric to one another and the plurality of telescoping rods 11 is composed of a count of at least two segments. The plurality of telescoping rods 11 is releasably collapsible and extending when the locking mechanism 13 is disengaged from a clamped position. The engagement of the locking mechanism 13 into one of the plurality of apertures 12 to a closed position produces an outward compressive force, locking the bar jam 10 in place within an entryway or other opening. The locking mechanism 13 is slidably and concentrically attached to the outer surface of the plurality of telescoping rods 11 through one of the plurality of apertures 12. The plurality of apertures 12 is distributed on the outer surface of at least one segment of the plurality of telescoping rods 11 and is conductive and coincident to the locking mechanism 13 to provide the engagement thereof to lock the bar jam 10 to any extension that fits the opening of any intended entryway. The first end bracket 14 and second end bracket 15 are detachably and terminally mounted to the plurality of telescoping rods 11 opposite each other along the plurality of telescoping rods 11. When installing the present invention to the frame of the entryway, the user can turn the plurality of telescoping rods 11 to exert pressure on the frame of the entryway through the first end bracket 14 and second end bracket 15 to tightly secure the present invention in place. The user then can lock the present invention using the locking mechanism 13.

Figure 3:
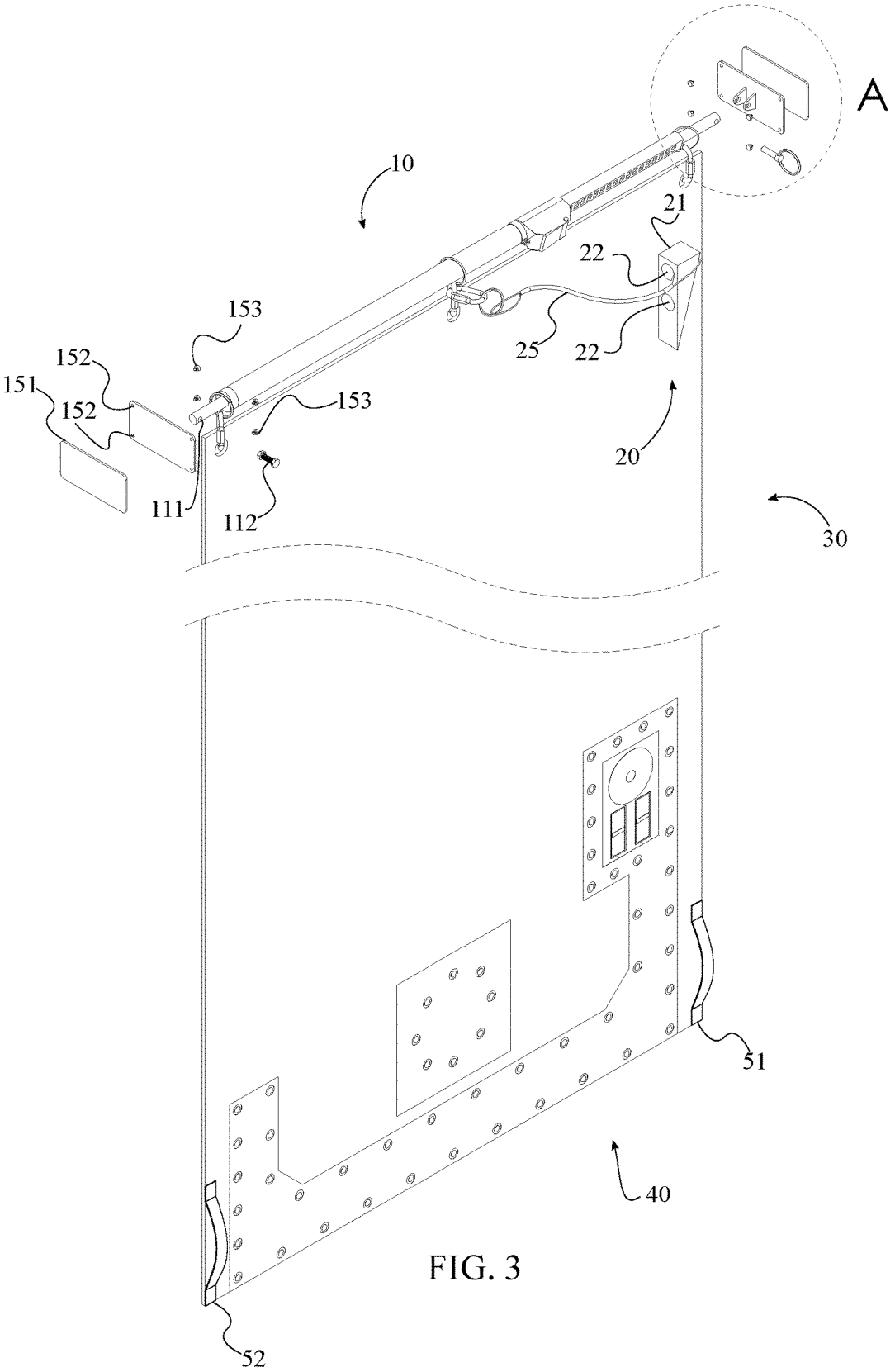
FIG. 3 is an exploded perspective front view of the present invention.
Figure 4:
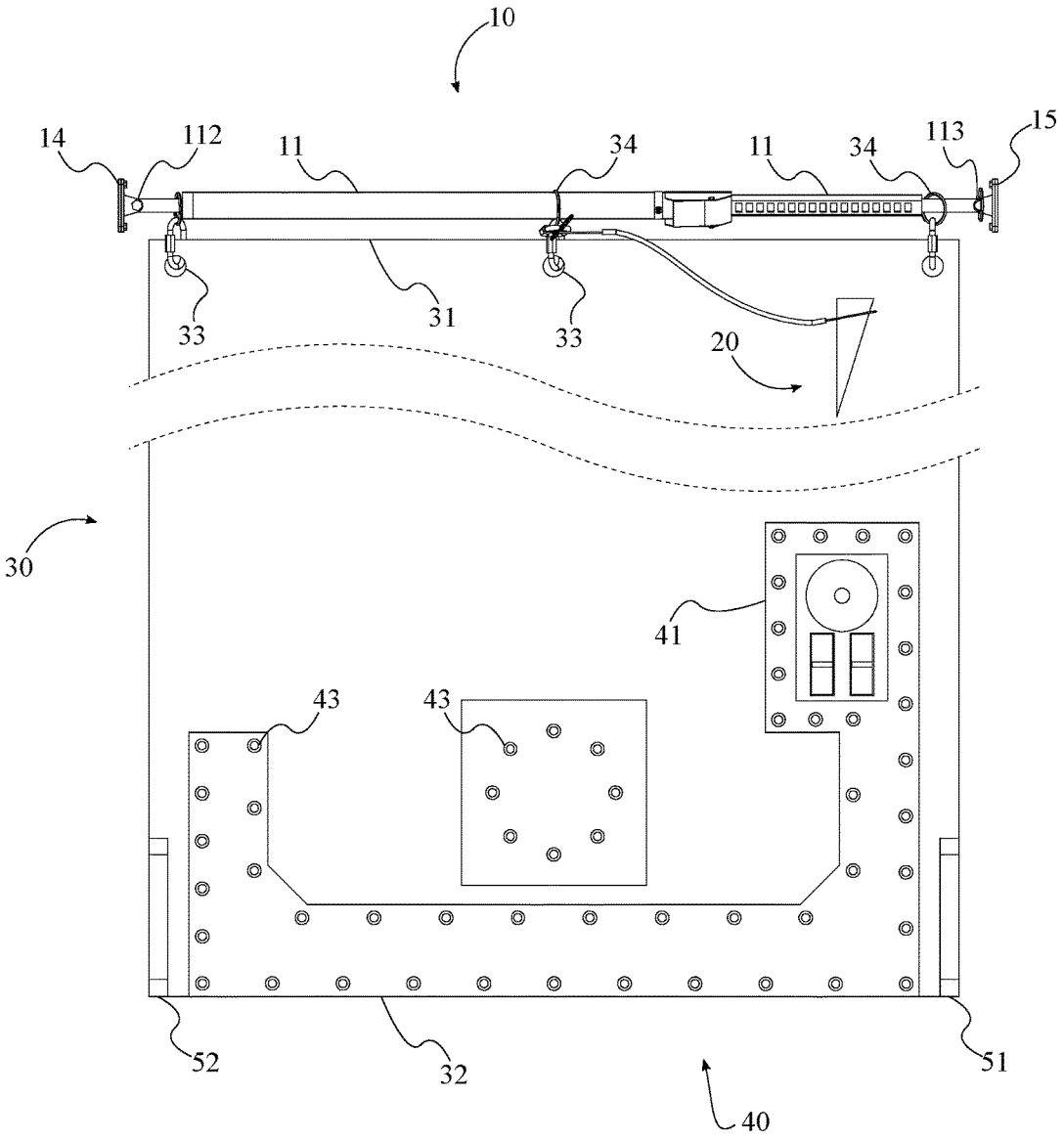
FIG. 4 is a front view of the present invention.

In reference to FIGS. 3-4 and 6, the plurality of telescoping rods 11 comprises a through hole 111, a first distal end 112, and a second distal end 113. The through hole 111 is positioned adjacent and traverses through each of the first distal end 112 and the second distal end 113 of the plurality of telescoping rods 11. The through hole 111 is used to mount each of the first end bracket 14 and the second end bracket 15 terminally on the plurality of telescoping rods 11. The plurality of telescoping rods 11 further comprises a first fastener 112, used to attach the first end bracket onto the first distal end 112 of the plurality of telescoping rods 11. The first fastener 112 can be any common fastener including, but not limited to, a bolt and nut. Both of the first end bracket 14 and the second end bracket 15 are removably and terminally connected to the plurality of telescoping rods 11. More specifically, each of the first end bracket 14 and the second end bracket 15 comprises a first mounting wing 16, a second mounting wing 17, an end stopper 151, a plurality of holes 152, and a plurality of second fasteners 153. The end stopper 151 is detachably and terminally attached to the outer surface of each of the first end bracket 14 and second end bracket 15, and positioned opposite the plurality of telescoping rods 11, through the plurality of holes 152 using the plurality of second fasteners 153. The plurality of second fasteners 153 may include, but is not limited to, screw, nail, or any suitable fastener. More specifically, the end stopper 151 may include, but is not limited to, silicone rubber or any other suitable material to provide a tight grip of the present invention to any desired entryway. The first mounting wing 16 and the second mounting wing 17 are perpendicularly connected to each of the first end bracket 14 and second end bracket 15 and spaced apart from each other. Additionally, each of the first mounting wing 16 and second mounting wing 17 comprises a hole 18 which can be aligned with the through hole 111 of one of the plurality of telescoping rods 11 for the attachment of each of the first end bracket 14 and second end bracket 15. The hole 18 of the first mounting wing 16 is centrally positioned on the first mounting wing 16. The hole 18 of the second mounting wing 17 is also centrally positioned on the second mounting wing 17. The hole 18 of the first mounting wing 16 and the hole 18 of the second mounting wing 17 are concentrically aligned with each other so that each of the first end bracket 14 and second end bracket 15 can be easily connected to the plurality of telescoping rods 11. More specifically, the first end bracket 14 is mounted to the first distal end 112 of the plurality of telescoping rods 11 through the through hole 111 and the hole 18 of each of the first mounting wing 16 and second mounting wing 17, using the first fastener 112. The second end bracket 15 is detachably and terminally attached to the second distal end 113 of the plurality of telescoping rods 11 through the through hole 111 and the hole 18 of each of the first mounting wing 16 and second mounting wing 17, using the ring head pin 19, adjacent the plurality of apertures 12 of the plurality of the telescoping rods 11. The ring head pin 19 allows the user to efficiently attach the door wedge 20 onto the bar jam 10 to create a purchase point for forcible entry of a vehicle door and/or a structure door. Additionally, the wedge 20 is rolled inside the canvas 30 after the use of the present invention for transportation and storage. When mounted on both distal ends of the plurality of telescoping rods 11, the first end bracket 14 and second end bracket 15 produce a rigid grip when the locking mechanism 13 is engaged and the bar jam 10 is installed within an entryway.

In reference to FIGS. 2-3, the door wedge 20 comprises a door wedge body 21, a plurality of apertures 22, a cable fastener 23, and a cable 24. The door wedge body 21 functions as a doorstop and can be specifically shaped to have blunt edges to be used as a door prying tool when attached to the bar jam 10. The plurality of apertures 22 is distributed on and traverses through the longitudinal portion of the door wedge body 21. The plurality of apertures 22 permits the door wedge 20 to removably secure over the second distal end 113 of the plurality of telescoping rods 11, adjacent the second end bracket 15. The geometry of the plurality of apertures 22 of the door wedge 20 is dictated by the distal end of the plurality of telescoping rods 11 to ensure a secure fit thereto when engaging the door wedge 20. The cable fastener 23 permits the cable 24 to engage between the door wedge 20 and bar jam 10 and retain the door wedge 20 to the second distal end 113 of the plurality of telescoping rods 11 of the bar jam 10. The cable fastener 23 provides for the disengagement of the cable 24 in a modular capacity and is be formed of, but not limited to, an annular ring. The cable fastener 23 may optionally include a means of disengagement such as a spring-loaded coupler that allows the door wedge 20 to be removed in instances where the entryway exceeds the distance of the cable and the bar jam 10 is installed at the top of the entryway while the door wedge 20 operates more reliably as a door blocker at the bottom of the entryway. Elsewise, the door wedge 20 is secured between the top and bottom of the entryway, when the door wedge 20 and the bar jam 10 are connected by the cable 24. The cable 24 is preferably made of a heat resistive material or chain. The cable 24 prevents the misplacement of the door wedge 20 when disengaged from the bar jam 10 in situations where the door wedge 20 may be forgotten in the heat of action.

Figure 5:
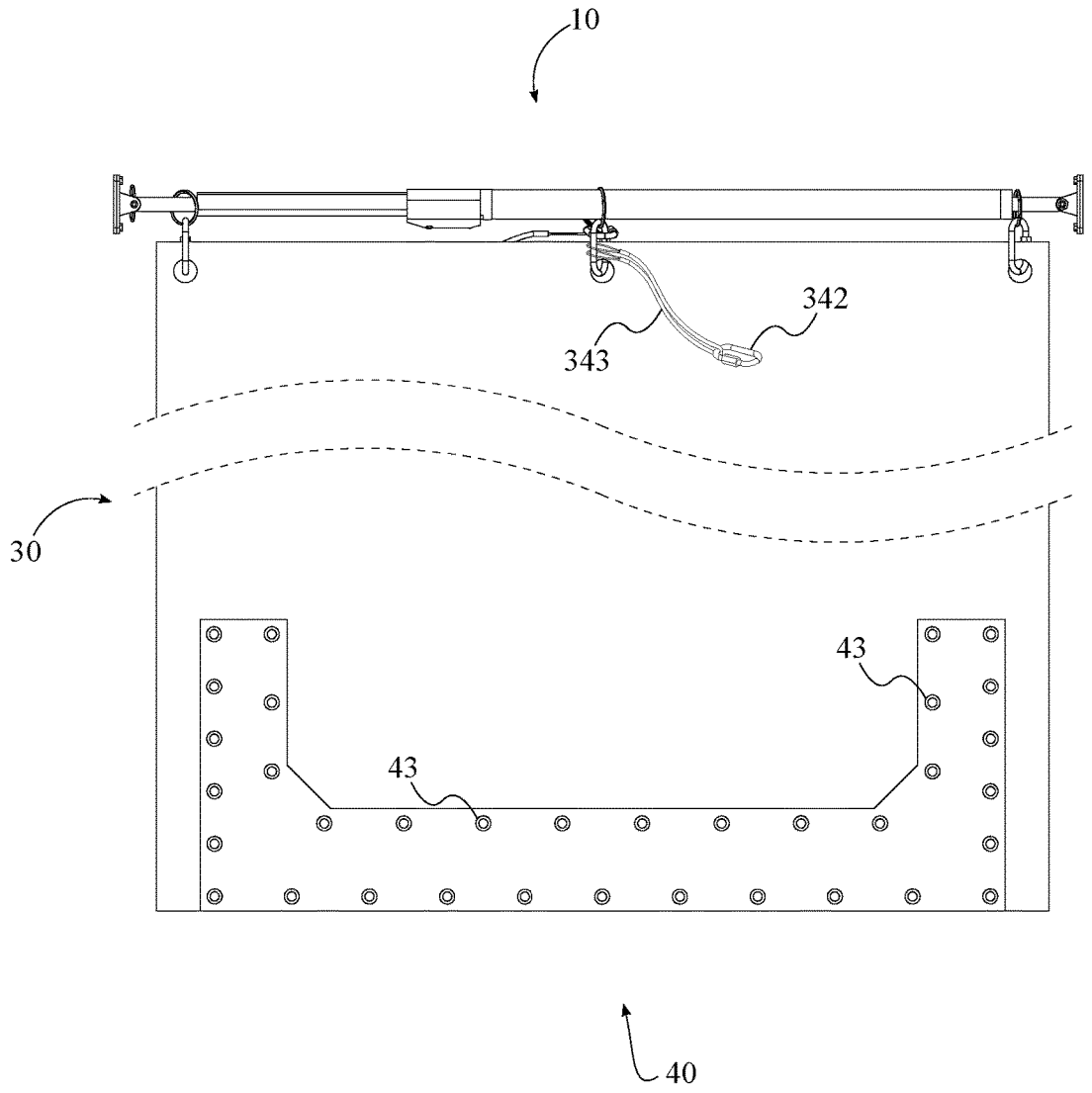
FIG. 5 is a rear view of the present invention.

In reference to FIG. 1-5, the canvas 30 comprises a first edge 31, a second edge 32, a plurality of holes 33, and a plurality of fasteners 34. The canvas 30 is preferably be made of a flexible canvas material that is further preferably made of a heat mitigating material. The canvas 30 inhibits the flow path of the smoke in an emergency and can be rolled up shape and being secured to the bar jam 10 before being deployed and secured within an entryway. Upon conclusion of use, the canvas 30 can be rewound around the bar jam 10 and secured by closing the locking mechanism 13 of the bar jam 10 until deployment is requisite once more. The plurality of holes 33 is laterally distributed across the first edge 31 of the canvas 30. The canvas 30 is detachably and terminally attached to the plurality of telescoping rods 11 of the bar jam 10 through plurality of holes 33 and using the plurality of fasteners 34. In the preferred embodiment of the present invention, each of the plurality of fasteners 34 comprises a loop 341 and a link 342, as seen in FIG. 6. The link 342 connects each of the plurality of holes on the first edge 31 and loop 341. The loop 341 is engaged on the plurality of telescoping rods 11 allowing the plurality of telescoping rods 11 to extend and contract freely where the loop 341 slides therewith. Additionally, the link 342 allows the user to conveniently disconnect the canvas 30 from the bar jam 10 for replacement, cleaning, and/or storage. Further, the canvas 30 comprises a cable 343, as seen in FIG. 5, which can be used to secure the canvas 30 when rolled up. More specifically, the cable 343 holding the link 342 is attached to one of the plurality of fasteners 34 when the canvas 30 is unfurled for use. After the use, the user can detach one end of the cable 343 from one of the plurality of fasteners 34 and the link 342 from the cable 343. The user rolls up the canvas 30 and wraps around the canvas 30 with the cable 343. Then the user attaches the cable 343 to the one of the plurality of fasteners 34 using the link 342.

In reference to FIGS. 1-5, and 7, the power alarm system 40 is positioned on the canvas 30 adjacent the second edge 32 of the canvas 30. The power alarm system 40 comprises an audio aperture 41, an audio alarm 42, a plurality of lights 43, a power source 44, a light switch 45, an audio switch 46, and a plurality of wires 47. The power alarm system 40 is operable upon demand by the light switch 45 and the audio switch 46, to engage the plurality of lights 43 and the audio alarm 42 separately in the preferred embodiment but supplied by the common power source 44 to both. In the preferred embodiment of the present invention, the audio aperture 41 is positioned adjacent to the second edge 32 and in the interstitial space within the canvas 30. The audio alarm 42, the audio switch 46, and the light switch 45 are positioned in the audio aperture 41. Additionally, the power source 44 is positioned in the audio aperture 41 adjacent the audio alarm 42. The plurality of lights 43 is positioned longitudinally across the canvas 30 adjacent the audio aperture 41 and controlled by the light switch 45. The plurality of lights 43 provides an adequate amount of illumination in obscuring conditions. Further preferably, the plurality of lights 43 is visible from both sides of the canvas 30 through a transparent housing or screen surrounding the individual light. The plurality of lights 43 in other embodiments may permit the use of light patterns, flashing, and the like as driven by a microprocessor preferably located in the audio aperture 41. In the preferred embodiment, each of the light switch 45 and audio switch 46 is a toggle-based button or switch that operates digitally between constantly on and constantly off.

Figure 7:
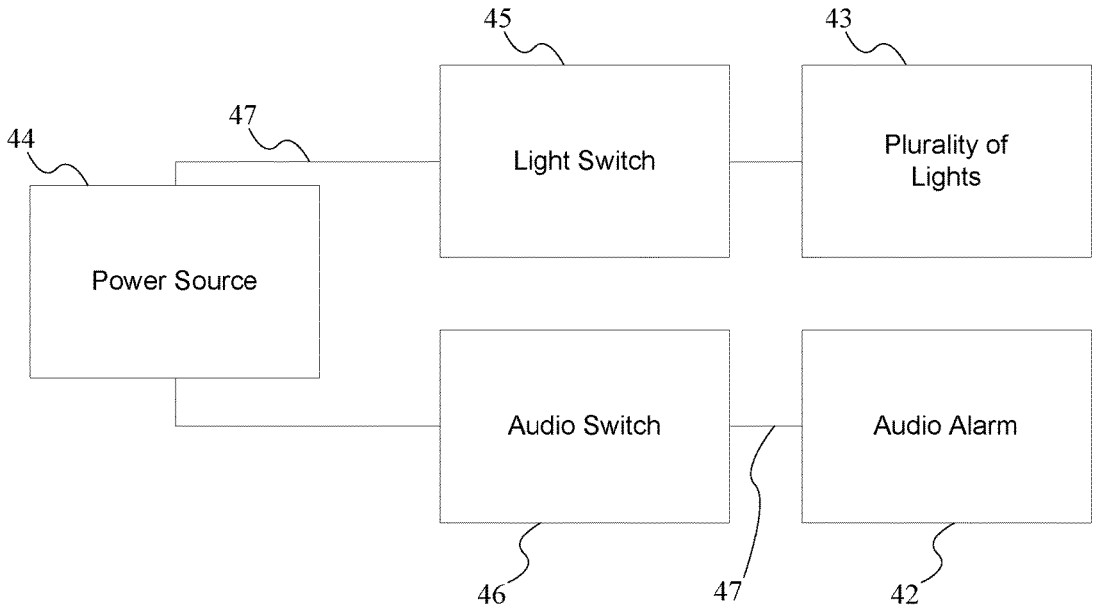
FIG. 7 is a diagram of the power alarm system of the present invention.

In reference to FIG. 7, the plurality of wires 47 enables the electrical connections between the power source 44, the light switch 45, the audio switch 46, the plurality of lights 43, and the audio alarm 42. The plurality of wires 47 permits the passage of electricity therebetween and permits the operation of the power alarm system 40 where the plurality of wires 47 is located within the interstitial space of the canvas 30, and within the audio aperture 41. The plurality of wires 47 can be in any number of configurations but is connected between the power source 44, the light switch 45 and the audio switch 46 in a parallel arrangement. Additionally, the plurality of wires 47 can be in series between the light switch 45, the audio switch 46, and the plurality of lights 43 and the audio alarm 42 separately before connecting back into the power source 44. In the preferred embodiment of the present invention, the power source 44 is disposable battery. In other embodiments, the power source 44 can be rechargeable through a port and jack that is linked to an abundant power source such as an outlet or USB jack. Additionally, the power source 44 can be replaceable when housed within the audio aperture 41. In the preferred embodiment of the present invention, the audio aperture 41 includes a rectilinear geometry, where the audio alarm 42 can be secured by any number of fastening means known to the art such as but not limited to: conventional fasteners, adhesives, snap fits, and so on. The audio alarm 42 is activated by the audio switch 46 and powered by the power source 44. The audio alarm 42 is driven by a small microprocessor or simple circuit to produce a continuous, intermittent, or deliberate sequence of notes and sounds produced by a speaker that is exposed to the audio aperture 41. The audio alarm 42 is preferably programmed to operate continuously so long as power is sustained once switched on by the audio switch 46 until being switched off, or the power source 44 is exhausted. The purpose of the audio alarm 42 is to aid in guiding firefighters and/or rapid intervention crews to the area in addition to guiding occupants of a domicile through obscured conditions to the apparatus and entryway. The audio alarm 42 further preferably includes a means of wireless activation that is enacted by an exterior crew of responders when it is alerted through extraneous means that the situation requires further assistance from on-site responders. In other embodiments, the audio alarm 42 may operate through the audio switch 46 as an auxiliary override measure optionally.

In reference to FIGS. 1-5, the first handle 51 and second handle 52, in combination with the canvas 30 and the bar jam 10, provide a convenient patient transportation means. The first handle 51 and second handle 52 are terminally and laterally attached to the longitudinal sides of the canvas 30 and positioned laterally opposite each other across the canvas 30, adjacent the second edge 32 of the canvas 30. Further, the first handle 51 and second handle 52 are flush to the longitudinal sides of the canvas 30 so that they are not interfering with the user during any intended activities.

To use the present invention, the user acquires a Roses Iron Curtain Entry Tool and removes the door wedge 20 from the distal end of the plurality of telescoping rods 11 of the bar jam 10. First, the user uses the door wedge 20 as a doorstopper to secure and keep the door open. Secondly, the user adjusts the plurality of telescoping rods 11 to fit into the opening of an intended entryway. The user then tightens the bar jam 10 onto the very top of the entryway by turning the plurality of telescoping rods 11 to exert pressure to the frame of the entryway and locks the bar jam 10 by engaging the locking mechanism 13 of the bar jam 10 with the first end bracket 14 and second end bracket 15 being securely engaged onto the entryway. Thirdly, the user unfurls the canvas 30 off the bar jam 10 to block the entryway. In this configuration, the user produces a combination of a forced entry tool and a flow path blocking device. The user or any emergency responder or like can use the light switch 45 to turn on the plurality of lights 43, and/or the audio switch 46 to turn on the audio alarm 42 at any specific time to aid in navigation and response of the firefighters and/or rapid intervention crews. Since the bar jam is installed at the very top of the entryway, the present invention eliminates the hazard that firefighters and/or rescuers may hit their heads going through the blocked opening.

In any medical events, the user can use canvas 30 of the Roses Iron Curtain Entry Tool as a tarp to cover a patient's fluids, or as a carrier for the rescuers to efficiently transport the patient. More specifically, the rescuer and/or emergency responder can use the present invention to cover a patient or an injured person to provide protections for themselves from infection of the patient's body fluids such as blood, vomit, etc. Thus, the rescuer and/or emergency responder can use the present invention to carry the patient as a safe transportation tool. In a traffic collision, for instance, the rescuer and/or emergency responder can use the present invention as a door prying tool while firefighters use extrication tools on vehicle, and then as a tarp to cover the injured person for protection.

After any use, the user can remove the door wedge 20 from the second distal end 113 of the plurality of telescoping rods 111 if the door wedge 20 is on the plurality of telescoping rods 111 adjacent the second distal end 113. Or the user can remove the door wedge 20 from the entryway if the door wedge 20 is used to block the door of the entryway. The user then places the door wedge 20 inside the canvas 30 as the user rolls up the canvas 20 for storage. The user secures the canvas 30 onto the bar jam 10 using the cable 342 and link 341 of the plurality of fasteners 34. Further, the user attaches the second end bracket 15 onto the second distal end 113 of the plurality of telescoping rods 11 by inserting the ring head pin into the first wing 17, hole 111, and the second mounting wing 18. Now, the present invention can be conveniently stored away or transported to the next site for use.

Although the invention has been explained in relation to its preferred embodiment, it is to be understood that many other possible modifications and variations can be made without departing from the spirit and scope of the invention.

What is claimed is:

1. A curtain entry tool for building and vehicle forced entry and carrying patients comprising:

a bar jam;

a door wedge;

a canvas;

the bar jam comprising a plurality of telescoping rods, a plurality of apertures, a locking mechanism, a first end bracket, and a second end bracket;

the plurality of apertures being distributed on the outer surface of at least one of the plurality of telescoping rods;

the first end bracket and second bracket being detachably and terminally mounted to the plurality of telescoping rods opposite each other along the plurality of telescoping rods;

the locking mechanism being slidably and concentrically attached to the outer surface of the plurality of telescoping rods through one of the plurality of apertures;

the door wedge being removably attached to the plurality of telescoping rods of the bar jam;

the canvas comprising a first edge, a second edge, a plurality of holes, and a plurality of fasteners;

the plurality of holes being laterally distributed across the first edge of the canvas;

the canvas being terminally attached to the plurality of telescoping rods of the bar jam at the first edge through the plurality of fasteners; and the second edge being positioned longitudinally opposite the first edge of the canvas.

2. The curtain entry tool for building and vehicle forced entry and carrying patients as claimed in claim 1 comprising:

a power alarm system;

the power system comprising an audio aperture, an audio alarm, a plurality of lights, a power source, a light switch, an audio switch, and a plurality of wires;

the audio aperture being positioned adjacent to the second edge of the canvas;

the audio alarm being attached to the audio aperture;

the plurality of lights being positioned longitudinally across the canvas adjacent the audio aperture;

the light switch being electrically connected between the power source and the light;

the audio switch connecting the power source and the audio alarm using the plurality of wires; and the power source being positioned in the audio aperture adjacent the audio alarm.

3. The curtain entry tool for building and vehicle forced entry and carrying patients as claimed in claim 1 comprising:

the bar jam comprising a ring head pin;

the plurality of telescoping rods comprising a first distal end and a second distal end;

each of the plurality of telescoping rods comprising a through hole;

the through hole traversing through each of the first distal end and the second distal end of the plurality of telescoping rods;

each of the first end bracket and second end bracket comprising a first mounting wing and a second mounting wing;

the first mounting wing and second mounting wing being spaced apart from each other of each of the first end bracket and second end bracket;

the first mounting wing and second mounting wing being perpendicularly connected to each of the first end bracket and second end bracket;

each of the first mounting wing and second mounting wing comprising a hole;

the hole of the first mounting wing being centrally positioned on the first mounting wing;

the hole of the second mounting wing being centrally positioned on the second mounting wing;

the hole of the first mounting wing and the hole of the second mounting wing being concentrically aligned with each other;

the first end bracket being mounted to the first distal end of the plurality of telescoping rods through the holes of the first mounting wing and the second mounting wing of the first end bracket; and the second end bracket being detachably and terminally attached to the second distal end of the plurality of telescoping rods through the ring head pin and the holes of the first mounting wing and the hole of the second mounting wing, adjacent the plurality of apertures of the plurality of the telescoping rods.

4. The curtain entry tool for building and vehicle forced entry and carrying patients as claimed in claim 1 comprising:

the first end bracket and the second end bracket comprising an end stopper; and the end stopper being detachably and terminally attached to each of the first end bracket and the second end bracket, opposite the plurality of telescoping rods.

5. The curtain entry tool for building and vehicle forced entry and carrying patients as claimed in claim 1 comprising:

the door wedge comprising a door wedge body, a plurality of apertures, a ring fastener, and a link;

the plurality of apertures being distributed on and traversing through a longitudinal portion of the door wedge body; and the door wedge being removably attached to the plurality of telescoping rods through one of the plurality of holes of the door wedge body, the link, and the ring fastener.

6. The curtain entry tool for building and vehicle forced entry and carrying patients as claimed in claim 1 comprising:

the door wedge comprising a door wedge body, a plurality of apertures, a cable fastener, and a cable;

the plurality of apertures being distributed on and traversing through a longitudinal portion of the door wedge body; and the door wedge being detachably attached to the plurality of telescoping rods through one of the plurality of holes of the door wedge body, the cable, and the cable fastener.

7. The curtain entry tool for building and vehicle forced entry and carrying patients as claimed in claim 1, wherein each of the plurality of fasteners of the canvas being a loop.

8. The curtain entry tool for building and vehicle forced entry and carrying patients as claimed in claim 1 comprising:

the canvas comprising a first handle and a second handle;

the first handle and second handle being terminally and laterally attached to the longitudinal sides of the canvas;

the first handle and second handle being flush to the longitudinal sides of the canvas; and the first handle and the second handle being positioned opposite each other across the canvas, adjacent the second edge.

9. The curtain entry tool for building and vehicle forced entry and carrying patients as claimed in claim 1 comprising:

each of the plurality of fasteners of the canvas comprising a loop and a link;

the loop being slidably positioned on the plurality of telescoping rods of the bar jam;

the link being removably attached to the loop and each of the plurality of holes of the first edge.

10. The curtain entry tool for building and vehicle forced entry and carrying patients as claimed in claim 9 comprising:

the canvas comprising a cable and a link;

the link being connected to the cable; and the cable being connected to the link of one of the plurality of fasteners.

11. A curtain entry tool for building and vehicle forced entry and carrying patients comprising:

a bar jam;

a door wedge;

a canvas;

a power alarm system;

the bar jam comprising a plurality of telescoping rods, a plurality of apertures, a locking mechanism, a first end bracket, and a second end bracket;

the plurality of apertures being distributed on the outer surface of at least one of the plurality of telescoping rods;

the first end bracket and second bracket being detachably and terminally mounted to the plurality of telescoping rods opposite each other along the plurality of telescoping rods;

the locking mechanism being slidably and concentrically attached to the outer surface of the plurality of telescoping rods through one of the plurality of apertures;

the door wedge being removably attached to the plurality of telescoping rods of the bar jam;

the canvas comprising a first edge, a second edge, a plurality of holes, and a plurality of fasteners;

the plurality of holes being laterally distributed across the first edge of the canvas;

the canvas being terminally attached to the plurality of telescoping rods of the bar jam at the first edge through the plurality of fasteners;

the second edge being positioned longitudinally opposite the first edge of the canvas;

the power system comprising an audio aperture, an audio alarm, a plurality of lights, a power source, a light switch, an audio switch, and a plurality of wires;

the audio aperture being positioned adjacent to the second edge of the canvas;

the audio alarm being attached to the audio aperture;

the plurality of lights being positioned longitudinally across the canvas adjacent the audio aperture;

the light switch being electrically connected between the power source and the light;

the audio switch connecting the power source and the audio alarm using the plurality of wires; and the power source being positioned in the audio aperture adjacent the audio alarm.

12. The curtain entry tool for building and vehicle forced entry and carrying patients as claimed in claim 11 comprising:

the bar jam comprising a ring head pin;

the plurality of telescoping rods comprising a first distal end and a second distal end;

each of the plurality of telescoping rods comprising a through hole;

the through hole traversing through each of the first distal end and the second distal end of the plurality of telescoping rods;

each of the first end bracket and second end bracket comprising a first mounting wing and a second mounting wing;

the first mounting wing and second mounting wing being spaced apart from each other of each of the first end bracket and second end bracket;

the first mounting wing and second mounting wing being perpendicularly connected to each of the first end bracket and second end bracket;

each of the first mounting wing and second mounting wing comprising a hole;

the hole of the first mounting wing being centrally positioned on the first mounting wing;

the hole of the second mounting wing being centrally positioned on the second mounting wing;

the hole of the first mounting wing and the hole of the second mounting wing being concentrically aligned with each other;

the first end bracket being mounted to the first distal end of the plurality of telescoping rods through the holes of the first mounting wing and the second mounting wing of the first end bracket; and the second end bracket being detachably and terminally attached to the second distal end of the plurality of telescoping rods through the ring head pin and the holes of the first mounting wing and the hole of the second mounting wing, adjacent the plurality of apertures of the plurality of the telescoping rods.

13. The curtain entry tool for building and vehicle forced entry and carrying patients as claimed in claim 11 comprising:

the first end bracket and the second end bracket comprising an end stopper; and the end stopper being detachably and terminally attached to each of the first end bracket and the second end bracket, opposite the plurality of telescoping rods.

14. The curtain entry tool for building and vehicle forced entry and carrying patients as claimed in claim 11 comprising:

the door wedge comprising a door wedge body, a plurality of apertures, a ring fastener, and a link;

the plurality of apertures being distributed on and traversing through a longitudinal portion of the door wedge body; and the door wedge being removably attached to the plurality of telescoping rods through one of the plurality of holes of the door wedge body, the link, and the ring fastener.

15. The curtain entry tool for building and vehicle forced entry and carrying patients as claimed in claim 11 comprising:

the door wedge comprising a door wedge body, a plurality of apertures, a cable fastener, and a cable;

the plurality of apertures being distributed on and traversing through a longitudinal portion of the door wedge body; and the door wedge being detachably attached to the plurality of telescoping rods through one of the plurality of holes of the door wedge body, the cable, and the cable fastener.

16. The curtain entry tool for building and vehicle forced entry and carrying patients as claimed in claim 11, wherein each of the plurality of fasteners of the canvas being a loop.

17. The curtain entry tool for building and vehicle forced entry and carrying patients as claimed in claim 11 comprising:

the canvas comprising a first handle and a second handle;

the first handle and second handle being terminally and laterally attached to the longitudinal sides of the canvas;

the first handle and second handle being flush to the longitudinal sides of the canvas; and the first handle and the second handle being positioned opposite each other across the canvas, adjacent the second edge.

18. The curtain entry tool for building and vehicle forced entry and carrying patients as claimed in claim 11 comprising:

each of the plurality of fasteners of the canvas comprising a loop and a link;

the loop being slidably positioned on the plurality of telescoping rods of the bar jam;

the link being removably attached to the loop and each of the plurality of holes of the first edge.

19. The curtain entry tool for building and vehicle forced entry and carrying patients as claimed in claim 18 comprising:

the canvas comprising a cable and a link;

the link being connected to the cable; and the cable being connected to the link of one of the plurality of fasteners.

* * * * *